US008356549B2

(12) United States Patent
Iversen et al.

(10) Patent No.: US 8,356,549 B2
(45) Date of Patent: Jan. 22, 2013

(54) METHOD OF MOUNTING A CYLINDER ARRANGEMENT OF A HERMETICALLY ENCLOSED REFRIGERANT COMPRESSOR ARRANGEMENT, AND HERMETICALLY ENCLOSED REFRIGERANT COMPRESSOR ARRANGEMENT

(75) Inventors: Frank Holm Iversen, Padborg (DK); Marten Nommensen, Flensburg (DE); Ekkehard Handke, Grossenwiehe (DE); Norbert Stöcken, Flensburg (DE)

(73) Assignee: Secop GmbH, Flensburg (DE)

( * ) Notice: Subject to any disclaimer, the term of this patent is extended or adjusted under 35 U.S.C. 154(b) by 922 days.

(21) Appl. No.: 12/466,428

(22) Filed: May 15, 2009

(65) Prior Publication Data

US 2010/0083826 A1 Apr. 8, 2010

(30) Foreign Application Priority Data

May 21, 2008 (DE) ..... 10 2008 024 670

(51) Int. Cl.
*F04B 39/12* (2006.01)
*F25B 1/02* (2006.01)

(52) U.S. Cl. ..... 92/128; 92/161

(58) Field of Classification Search ..... 92/128, 92/161; 417/360, 363
See application file for complete search history.

(56) References Cited

U.S. PATENT DOCUMENTS

| | | | | |
|---|---|---|---|---|
| 4,808,085 | A * | 2/1989 | Nishitsuji | 417/363 |
| 6,095,768 | A | 8/2000 | Bianchi | |
| 7,244,109 | B2 * | 7/2007 | Park et al. | 417/321 |
| 7,276,829 | B2 * | 10/2007 | Seo | 417/424.1 |

FOREIGN PATENT DOCUMENTS

EP 0 524 552 A1 7/1992

* cited by examiner

*Primary Examiner* — Thomas E Lazo
(74) *Attorney, Agent, or Firm* — McCormick, Paulding & Huber LLP

(57) ABSTRACT

The invention concerns a method of mounting a cylinder arrangement of a hermetically enclosed refrigerant compressor arrangement in a carrier arrangement (14, 15), in which the cylinder arrangement is inserted in the carrier arrangement (14, 15), aligned in relation to a crank shaft (5) and connected to the carrier arrangement (14, 15). It is endeavored to ensure a good efficiency of the refrigerant compressor arrangement. For this purpose the carrier arrangement is deformed, before inserting the cylinder arrangement, by means of a calibration cylinder (40), until the calibration cylinder (40) has a predetermined alignment, after which the calibration cylinder (40) is removed and replaced by the cylinder arrangement in the carrier arrangement (14, 15).

13 Claims, 3 Drawing Sheets

METHOD OF MOUNTING A CYLINDER ARRANGEMENT OF A HERMETICALLY ENCLOSED REFRIGERANT COMPRESSOR ARRANGEMENT, AND HERMETICALLY ENCLOSED REFRIGERANT COMPRESSOR ARRANGEMENT

CROSS REFERENCE TO RELATED APPLICATION

Applicant hereby claims foreign priority benefits under U.S.C. §119 from German Patent Application No. 10 2008 024 670.0 filed on May 21, 2008, the contents of which are incorporated by reference herein.

FIELD OF THE INVENTION

The invention concerns a method of mounting a cylinder arrangement of a hermetically enclosed refrigerant compressor arrangement in a carrier arrangement, in which the cylinder arrangement is inserted in the carrier arrangement, aligned in relation to a crank shaft and connected to the carrier arrangement.

BACKGROUND OF THE INVENTION

Further, the invention concerns a hermetically enclosed refrigerant compressor arrangement with a crank shaft and a cylinder arrangement, in which a piston is arranged that is connected to the crank shaft via a connecting rod, the cylinder arrangement being supported on a carrier.

Such a hermetically enclosed refrigerant compressor arrangement is, for example, known from U.S. Pat. No. 6,095,768, EP 0 524 552 A1 or U.S. Pat. No. 7,244,109 B2.

Hermetically enclosed refrigerant compressors are used in many domestic and industrial refrigeration appliances, for example, refrigerators, refrigerating chests, freezers, top opening freezers or refrigerating cabinets. They are manufactured in large numbers and must thus be regarded as mass products, which should be manufactured in the most cost effective way possible.

In order to simplify the manufacturing, the cylinder arrangements are, in the cases mentioned above, arranged on a carrier, which is made to be relatively stable, and which is connected to the stator of the drive motor. Thus, it is no longer required to make the cylinder arrangement and the bearing for the rotor of the drive motor in one piece.

Such an embodiment has the disadvantage that it is difficult to mount the cylinder arrangement of the refrigerant compressor arrangement with the exact alignment. It is desired to position the cylinder arrangement so that the axis of the cylinder arrangement extends exactly at right angles to the axis of the crank shaft. If this is not the case, this may cause cocking of the piston in the cylinder during operation, which would cause increased wear. A cocked cylinder also requires more energy during operation, which has a negative influence on the efficiency.

SUMMARY OF THE INVENTION

The invention is based on the task of ensuring a good efficiency of a refrigerant compressor arrangement.

With a method as mentioned in the introduction, this task is solved in that, before inserting the cylinder arrangement, the carrier arrangement is deformed by means of a calibration cylinder, until the calibration cylinder has a predetermined alignment, after which the calibration cylinder is removed and replaced by the cylinder arrangement in the carrier arrangement.

With this embodiment, a carrier arrangement (or short: a carrier) can be used, which has been pre-manufactured with a relatively poor accuracy. The accuracy of the manufacturing of the accommodation, in which finally the cylinder arrangement is inserted, will only be achieved by the use of the calibration cylinder. At least with regard to the diameter, the calibration cylinder has outer dimensions, which correspond to those of the cylinder arrangement. Otherwise, the calibration cylinder only has to be so stable that it can deform the carrier. Usually, in this connection, it is endeavoured to avoid a deformation of the calibration cylinder. When the calibration cylinder is acted upon by a sufficient force, it can deform the carrier. This deformation is controlled by the force applied, so that the axis of the calibration cylinder preferably crosses the axis of the crank shaft, or, if the cylinder is laterally offset in relation to the crank shaft axis, a parallel to the crank shaft axis. When, then, the calibration cylinder is removed from the carrier, the accommodation has a geometry, into which the cylinder arrangement fits exactly, so that also the axis of the cylinder arrangement crosses the crank shaft axis or a line that extends in parallel to the crank shaft axis. In any case, the cylinder arrangement can then be mounted so that its axis crosses the crank shaft axis or a parallel thereto under a right angle.

Preferably, a carrier arrangement is used with projections extending in the direction of the cylinder arrangement, and the projections are deformed. If only the projections must be deformed, a smaller force is required, than would be required for the deformation of the whole carrier arrangement. Accordingly, the deformation of the carrier arrangement can be made with a better accuracy. The risk that during the deformation of the carrier arrangement other parts of the carrier arrangement outside the projections are deformed in an undesired manner is relatively small. This means that the deformation of the carrier arrangement can be concentrated on an area, where the deformation is desired.

It is preferred that at least two rows of projections are used, projections being farther away from the crank shaft being higher than projections, which are closer to the crank shaft. With this embodiment, it is achieved that during insertion the calibration cylinder initially has an inclination in relation to the alignment, which it must finally assume. This inclination is pre-specified by the different heights of the projections. Thus, it is also specified, where a force must be applied in order to deform the projections. The calibration cylinder is then tilted from its inclined position to the desired position; the force applied deforming the higher projections more than the lower projections. This is a simple and fast way of achieving the desired deformation of the carrier arrangement.

It is preferred that in the area of the higher projections a press force is applied on the calibration cylinder. When the press force is applied in the area of the higher projections, it is applied, where it can immediately be active. It must be assumed that with this method, mainly the higher projections are deformed. This keeps the deformation work small.

It is preferred that two rows are provided, each row having two projections. This means that a total of four projections is provided, of which two are higher than the other two. Four projections provide a sufficiently stable support for the cylinder arrangement to be mounted.

Preferably, before connecting the cylinder arrangement to the carrier arrangement, the cylinder arrangement is displaced on the carrier arrangement in a direction perpendicular to the crank shaft axis, until a dead space inside the cylinder arrangement has reached a predetermined minimum value. After the deformation, the deformed projections or the deformation zone of the carrier arrangement as a whole are formed so that during a displacement along the axis of the cylinder arrangement, that is, perpendicular to the crank shaft axis, a change of the angle between the cylinder axis and the crank shaft axis will not occur. This can be utilised to displace the cylinder towards or away from the crank shaft, until the dead space occurring in the upper dead point of the piston has reached its minimum value. The smaller the dead space is, the better is the efficiency of the refrigerant compressor arrangement.

Preferably, a calibration cylinder is used, whose one front side extends perpendicular to its axis, and that in at least two positions a distance of the front side to the crank shaft axis, or a line parallel to that, is determined, the carrier arrangement being deformed, until the distances are equal. The two positions are offset in relation to each other in parallel to the crank shaft axis. As long as the calibration cylinder is inclined, the two positions have different distances to the crank shaft axis or a line parallel thereto. Not until one front side of the calibration cylinder is vertical, the distances are the same. In this case, however, the axis of the calibration cylinder extends perpendicular to the crank shaft axis or a line parallel thereto.

Preferably, the parallel line used is a line on the circumference of a crank pin, which is connected to the crank shaft. This is particularly advantageous, if the axis of the cylinder arrangement and the crank shaft axis do not cross, but the cylinder arrangement is laterally offset in relation to the crank shaft. Then, the crank pin can be turned to the desired position, and measuring can be performed.

It is also advantageous, if a carrier arrangement is used, which comprises a carrier element and a reinforcement element, the reinforcement element being deformed. The use of a reinforcement element makes it possible to reduce the mass of the carrier arrangement. The carrier element can be dimensioned with a view to the fixing on the stator and the reinforcement element can be dimensioned with a view to the fixing of the cylinder arrangement. Accordingly material only has to be provided, where it is required for the corresponding application purpose. Additionally, the use of two elements, which are joined, can provide acoustic advantages, as, for example, the intrinsic frequency of the joined carrier arrangement is displaced from the audible area, and vibrations are damped. The carrier element and the reinforcement element can, for example, be made as shaped metal sheet parts, which can be manufactured with the required accuracy in a cost effective manner. In order to achieve the ultimate accuracy of the alignment of the axis of the cylinder arrangement to the crank shaft axis, the reinforcement element is deformed.

Preferably, the cylinder arrangement and the carrier arrangement are joined by means of a cold-formed joint. The cold-formed joint can, for example, be achieved by toxing or clinching. Thus, auxiliary joining parts can be saved. Deformations caused by a thermal load can be avoided. Thus, the accuracy of the alignment is not influenced by the joining process.

With a refrigerant compressor arrangement as mentioned in the introduction, the task is solved in that the carrier arrangement has at least one deformed deformation zone.

When the cylinder arrangement is mounted, the deformation zone has previously been deformed by the calibration cylinder. Thus, in the deformation zone it can be determined, if such a deformation has taken place. The deformation of the deformation zone causes that the axis of the cylinder arrangement and the crank shaft axis or a line parallel thereto cross each other under a right angle. Thus, the piston can be guided in the cylinder without risking a cocking, which keeps the wear and the energy consumption during operation small.

Preferably, the deformation zone has several projections directed towards the cylinder arrangement, at least one of these projections being deformed. During the deformation, the height of the deformed projection is reduced, so that the axis of the cylinder arrangement gets the desired alignment, namely at right angles to the crank shaft axis or a line parallel thereto.

It is also advantageous, if a projection far away from the crank shaft is more deformed than a projection next to the crank shaft. With a carrier arrangement, whose deformation zone comprises more or less deformed projections, the projections would, before the deformation, have different heights. Accordingly, the calibration cylinder can be inserted in the deformation zone with a certain inclination, and this inclination can then be removed by an external force application, so that the axis of the cylinder arrangement gets the desired alignment.

Preferably, the carrier arrangement has a carrier element mounted on a motor and a reinforcement element connected to the cylinder arrangement, the deformation zone being located in the reinforcement element. As mentioned above, the carrier arrangement can then be made with a relatively small mass. The carrier element can be dimensioned for the mounting on the motor. The reinforcement element, however, is dimensioned for accommodating the cylinder arrangement. Accordingly, material will only be provided, where it is required for the individual purposes. With an assembled carrier arrangement, the resonant frequency can under certain circumstances be displaced into a non-audible range.

In the following, the invention is described on the basis of a preferred embodiment in connection with the drawings, showing:

DETAILED DESCRIPTION OF THE PREFERRED EMBODIMENTS

Figure 1:
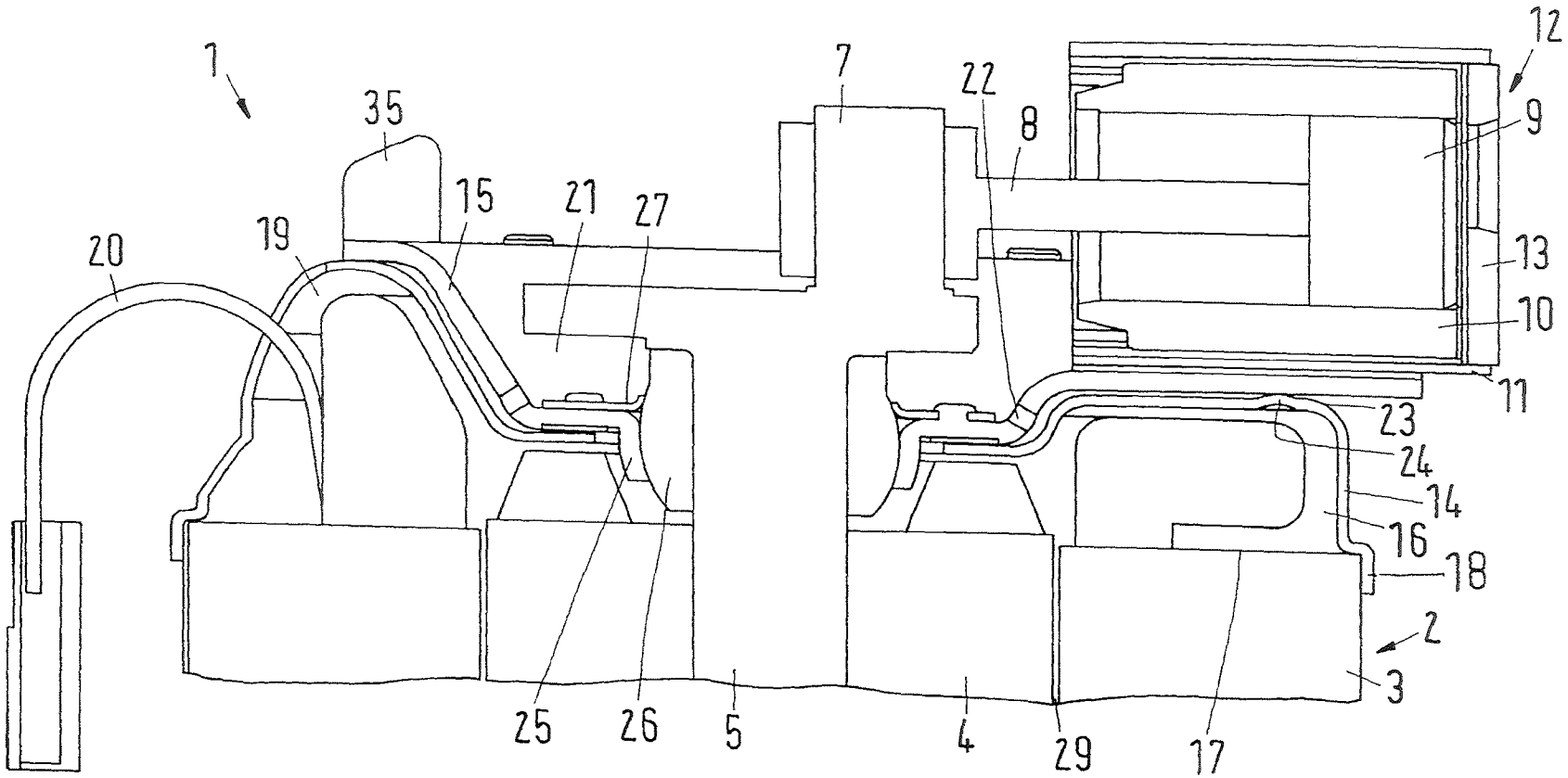
FIG. 1 is a schematic, partial section through a refrigerant compressor arrangement.

A refrigerant compressor arrangement 1 has a motor 2 with a stator 3 and a rotor 4, having between them an air gap 29. The rotor 4 is unrotatably connected to a rotor shaft 5 (also called "crank shaft), having at its lower end an oil pump and at its upper end a crank pin 7. For reasons of clarity, a casing usually surrounding the refrigerant compressor arrangement 1 is not shown.

Via a connecting rod 8, the crank pin 7 is connected to a piston 9, which reciprocates in a cylinder 10. The cylinder 10 is arranged in a mounting sleeve 11. The cylinder 10 and the mounting sleeve 11 form a cylinder arrangement 12, which also comprises a cylinder head 13, which is only schematically shown.

A connection between the cylinder arrangement 12 and the motor 2 is realised via a carrier, in the present case comprising a carrier element 14 and a reinforcement element 15.

The carrier element 14 has four flanges 16, which rest with a bearing surface 17 on a front side of the stator 3. Flaps 18 being angled in relation to the bearing surface 17, ensure that the carrier element 14 is undisplaceably held on the stator 3. The flanges 16 can then be welded onto or otherwise connected to the stator 3.

The carrier element 14 has a cable entry opening 19, through which an electrical supply cable 20 for the motor 2 is guided.

Figure 2:
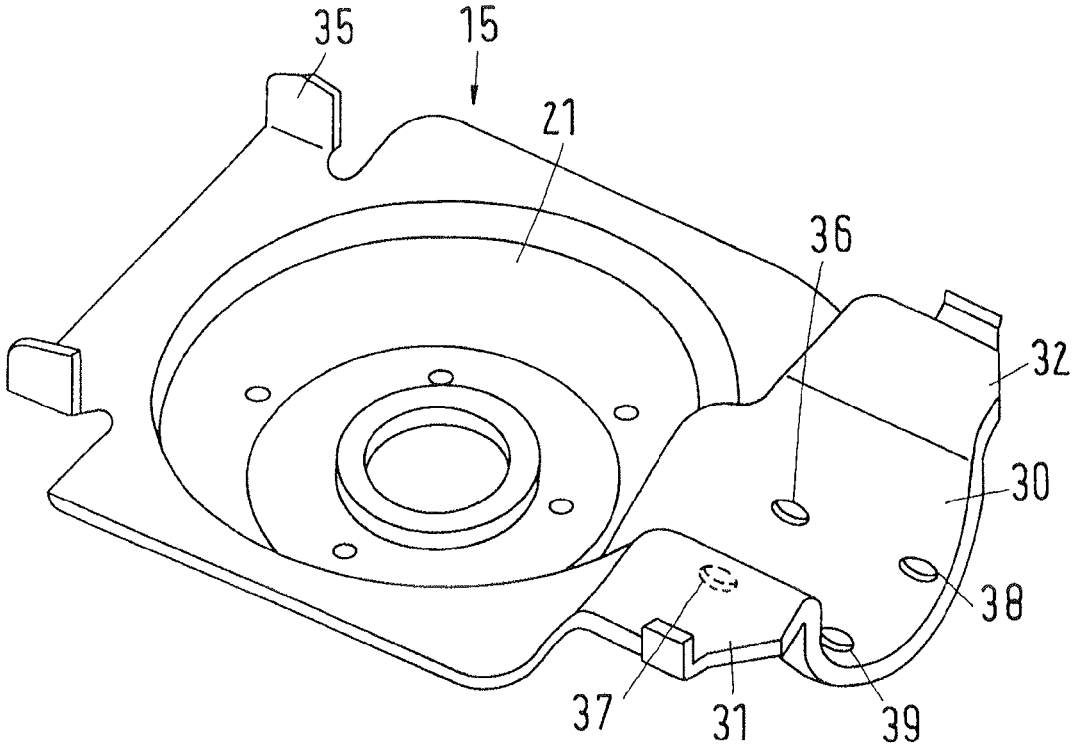
FIG. 2 is a perspective view of a reinforcement element.

As shown in FIG. 2, the reinforcement element 15 forms a pan 21. In this pan 21, oil gathers that is pumped upwards by the oil pump during operation and sprayed inside a case, not shown in detail, in which the refrigerant compressor arrangement 1 is located. Through an oil passage 22, this oil can get into a gap 23 between the carrier element 14 and the reinforcement element 15, from where it can flow off. This gap 23 is kept open by a spacer 24, which is formed on the carrier element 14.

The carrier element 14 and the reinforcement element 15 are made as formed sheet metal parts, that is, they are made during one or more working steps by means of punching and bending sheet metal plates. The sheet metal plate used for the carrier element 14 is thinner than the one used for the reinforcement element 15.

The reinforcement element 15 forms a bearing shell 25 for a calotte ring 26, in which the rotor shaft 5 is supported. The calotte ring 26 has a circumferential surface that forms a part of a spherical surface. The bearing shell 25 has an inner surface, which also forms a part of a spherical surface. The spherical surface of the calotte ring 26 has a somewhat smaller radius than the spherical surface of the bearing shell 25. The calotte ring 26 is held in the bearing shell 25 by a clamp 27. The clamp 27 prevents the calotte ring 26 from moving out of the bearing shell 25. However, it permits a certain tilting movability of the calotte ring 26 in relation to the reinforcement element 15.

As can particularly be seen from FIG. 2, the reinforcement element 25 has a trough shaped accommodation 30 for the mounting sleeve 11. Fixing surfaces 31, 32 are located next to the accommodation 30. The mounting sleeve 11 comprises flanges bent out from its surface. When the mounting sleeve 11 has not yet been connected to the reinforcement element 15, these flanges can enclose an obtuse angle. When the mounting sleeve 11 is inserted in the accommodation 30 and pressed into the accommodation 30 with a certain force, the flanges align in parallel to the fixing surfaces 31, 32. In this state, the flanges can be connected to the fixing surfaces 31, 32 by means of toxing or clinching. Before connecting the flanges to the fixing surfaces 31, 32, the mounting sleeve 11 with the cylinder 10 inside can be displaced in the axial direction within certain limits, so that in this manner a dead space can be set, which will at the end still remain at the upper dead point of the piston 9. This dead space should be kept as small as possible.

The reinforcement element 15 has four projections 36-39, which are located in the accommodation 30. These projections 36-39 are directed towards the cylinder arrangement 12, when the cylinder arrangement 12 is mounted in the reinforcement element 15, as shown in FIG. 1.

In the "raw state", that is, after manufacturing the reinforcement element 15 and before mounting the cylinder arrangement 12, the projections 36, 37, which are arranged next to the rotor shaft 5, have a smaller height than the projections 38, 39, which are located farther away from the rotor shaft 5. All in all, four projections 36-39, which are arranged in two rows, will be sufficient to support the cylinder arrangement 12 with the required reliability and accuracy in the accommodation 30, when eventually the cylinder arrangement 12 can be connected to the fixing surfaces 31, 32.

Figure 3:
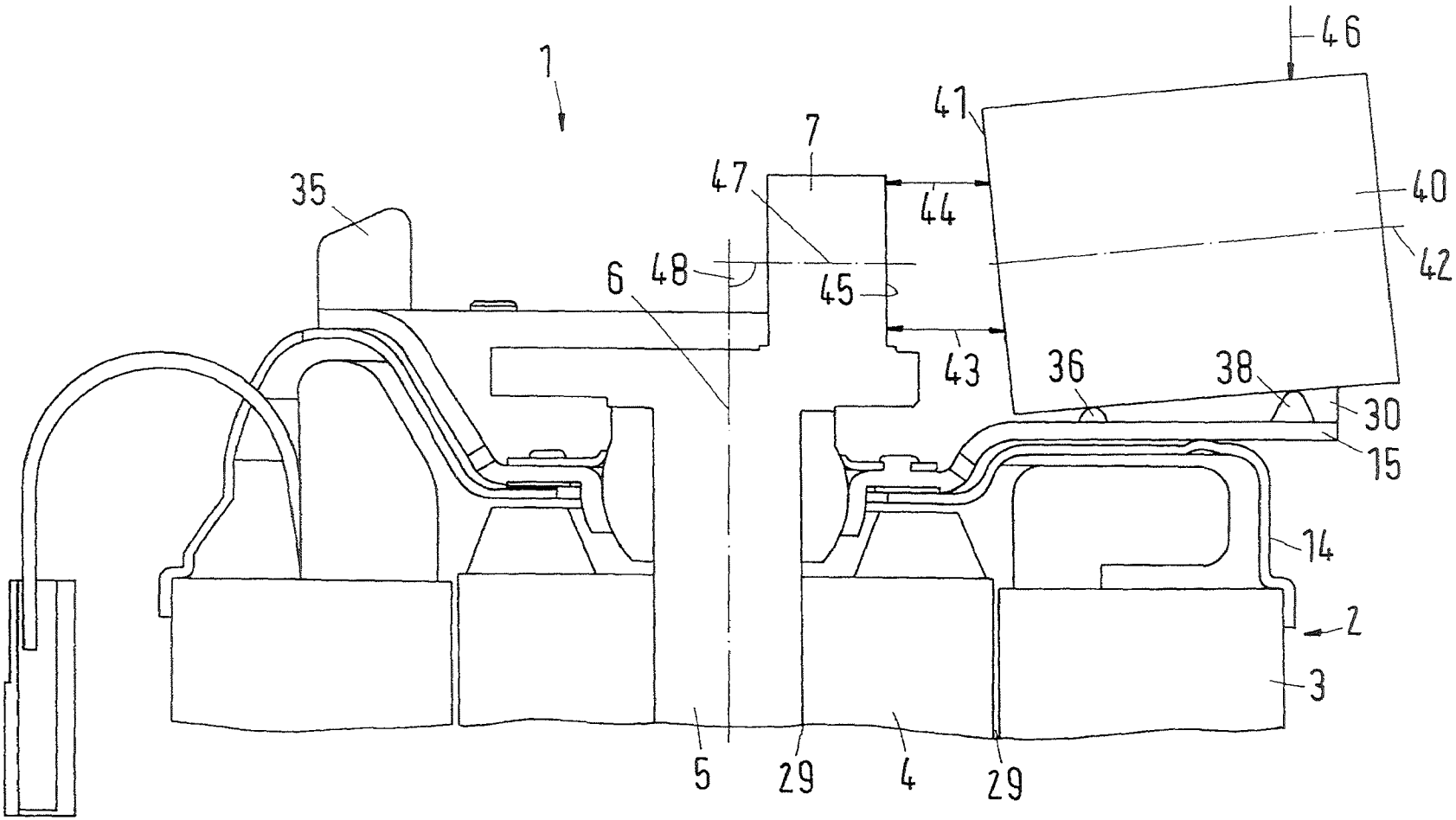
FIG. 3 is a view according to FIG. 1 with a calibration cylinder.

In order to provide the desired alignment of the cylinder arrangement 12 in the reinforcement element 15, a calibration cylinder is used, as shown in FIG. 3. The same elements as in FIGS. 1 and 2 are provided with the same reference numbers. In order to simplify the explanation, the projections 36, 38 are arranged in the section level. As can be seen from FIG. 2, however, they are actually located a small distance away from the section level in the circumferential direction.

As mentioned above, the projections 38, 39 are higher than the projections 36, 37. This means that, when the calibration cylinder 40 is inserted in the accommodation 30, it will tilt, as can be seen from FIG. 3. In other words, it has an inclination.

The calibration cylinder 40 has a front side 41, which extends perpendicularly to its axis 42. Accordingly, as long as the reinforcement element 15 with its projections 36-39 has not yet been deformed, a first distance 43 between the front side 41 and the circumferential surface of the crank pin 7 is larger than a distance 44 between the front side 41 of the calibration cylinder 40 and the circumferential surface of the crank pin 7 at the same circumferential position. This circumferential surface 45 of the crank pin 7 extends in parallel to the axis 6 of the rotor shaft 5.

The calibration cylinder 40 is now loaded with a force 46 (symbolized by an arrow). In relation to the axial direction of the calibration cylinder 40, this force 46 is applied in the area of the projections 38, 39. With a correspondingly large force, these projections 38, 39 are deformed. At any rate they are more heavily deformed than the other projections 36, 37.

This deformation of the projections 38, 39 reduces the inclination of the axis 42 of the calibration cylinder 40, until it coincides with a straight line 47 that encloses a right angle 48 with the axis 6 of the motor shaft. When the cylinder arrangement is somewhat laterally offset, the straight line 47 can also enclose a right angle with a parallel to the axis 6 of the rotor shaft 5.

The alignment of the calibration cylinder 40 can easily be monitored in that the distances 43, 44 are currently compared to each other. As soon as these distances have become the same, the axis 42 of the calibration cylinder 40 extends with the desired alignment, that is, together with the axis 6 of the rotor shaft 5, or a parallel to that, it encloses a right angle 48.

When now the calibration cylinder 40 is replaced by the cylinder arrangement 12, also the cylinder arrangement 12 has the desired alignment to the axis 6 of the crankshaft 5, as the cylinder arrangement 12 and the calibration cylinder 40 have the same outer dimensions.

Then the cylinder arrangement 12 can be displaced towards or away from the crank pin 7, until a dead space formed by the piston 9 and the cylinder 10 as well as the cylinder head 13 has reached a minimum value.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A method of mounting a cylinder arrangement of a hermetically enclosed refrigerant compressor arrangement in a carrier arrangement, in which the cylinder arrangement is inserted in the carrier arrangement, aligned in relation to a crank shaft and connected to the carrier arrangement, wherein, before inserting the cylinder arrangement, the carrier arrangement is deformed by means of a calibration cylinder, until the calibration cylinder has a predetermined alignment, after which the calibration cylinder is removed and replaced by the cylinder arrangement in the carrier arrangement.

2. The method according to claim 1, wherein a carrier arrangement is used with projections in the direction of the cylinder arrangement, and the projections are deformed.

3. The method according to claim 2, wherein at least two rows of projections are used, projections being farther away from the crank shaft being higher than projections, which are closer to the crank shaft.

4. The method according to claim 3, wherein in the area of the higher projections a press force is applied on the calibration cylinder.

5. The method according to claim 3, wherein two rows are provided, each row having two projections.

6. The method according to claim 1, wherein before connecting the cylinder arrangement to the carrier arrangement, the cylinder arrangement is displaced on the carrier arrangement vertically to the crank shaft axis, until a dead space inside the cylinder arrangement has reached a predetermined minimum value.

7. The method according to claim 1, wherein a calibration cylinder is used, whose one front side extends vertically to its axis, and in at least two positions a distance of the front side to the crank shaft axis, or a line parallel to that, is determined, the carrier device being deformed, until the distances are the same.

8. The method according to claim 7, wherein the parallel line used is a line on the circumference of a crank pin, which is connected to the crank shaft.

9. The method according to claim 1, wherein a carrier arrangement is used, which comprises a carrier element and a reinforcement element, the reinforcement element being deformed.

10. The method according to claim 1, wherein the cylinder arrangement and the carrier arrangement are joined by means of a cold-form joining method.

11. A hermetically enclosed refrigerant compressor arrangement with a crank shaft and a cylinder arrangement, in which a piston is arranged that is connected to the crank shaft via connecting rod, the cylinder arrangement being supported on a carrier, wherein the carrier arrangement has at least one deformed deformation zone; and wherein the deformation zone has several projections directed towards the cylinder arrangement, at least one of these projections being deformed.

12. The refrigerant compressor arrangement according to claim 11, wherein a projection far away from the crank shaft is more deformed than a projection next to the crank shaft.

13. The refrigerant compressor arrangement according to claim 11, wherein the carrier arrangement has a carrier element mounted on a motor and a reinforcement element connected to the cylinder arrangement, the deformation zone being located in the reinforcement element.

* * * * *